United States Patent [19]

Schmidt

[11] 3,985,292

[45] Oct. 12, 1976

[54] SELF-CLEANING CENTRIFUGE DRUM WITH A PISTON VALVE DEFINING ONE SIDE OF THE SLUDGE CHAMBER

[75] Inventor: Reinhard Schmidt, Oelde, Germany

[73] Assignee: Westfalia Separator AG, Oelde, Germany

[22] Filed: Nov. 5, 1973

[21] Appl. No.: 413,147

[30] Foreign Application Priority Data

Dec. 27, 1972 Germany ..... 2263664

[52] U.S. Cl. ..... 233/20 A

[51] Int. Cl.[2] ..... B04B 11/00

[58] Field of Search ..... 233/20 R, 20 A

[56] References Cited

UNITED STATES PATENTS

| | | | |
|---|---|---|---|
| 3,160,589 | 12/1964 | Stone | 233/20 A |
| 3,754,701 | 8/1973 | Bruning | 233/20 A |

FOREIGN PATENTS OR APPLICATIONS

| | | | |
|---|---|---|---|
| 2,022,198 | 5/1971 | Germany | 233/20 A |
| 938,324 | 10/1963 | United Kingdom | 233/20 A |

*Primary Examiner*—George H. Krizmanich
*Attorney, Agent, or Firm*—Burgess, Dinklage & Sprung

[57] ABSTRACT

A centrifugal separator constructed for intermittent discharge of sludge. One end member of the separator drum is a piston valve movable vertically to open and close sludge discharge nozzles disposed at the outer periphery of the drum. The piston valve forms one end of the sludge chamber in the drum. Radially inwardly of the sludge chamber, a cap is mounted in the separator drum covering a part of the piston valve and the cap and piston valve are in sliding sealing contact, providing an opening chamber on the drum side of the piston valve for receiving and holding fluid to force the piston valve to the open position. On other side of the piston valve, a closing chamber is provided for receiving fluid for closing of the valve. Means are provided for discharging fluid from the opening chamber so that the opening chamber can be empty for the closed position of the piston valve, whereby the force holding the piston valve in the closed position is increased.

4 Claims, 1 Drawing Figure

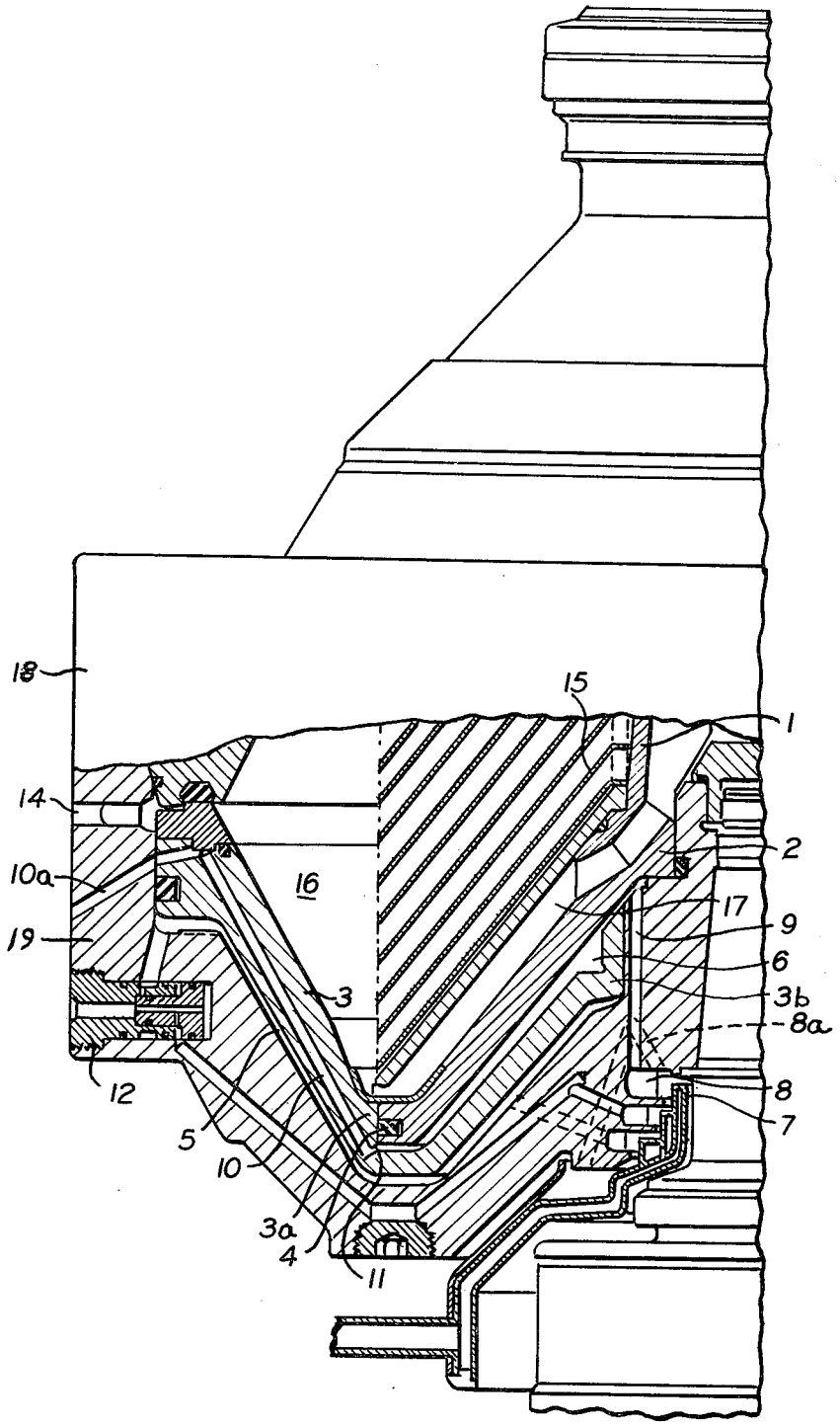
18
15
1
14
2
10a
16
17
9
19
6
3
3b
8a
12
8
7
5
10
3a
4
11

SELF-CLEANING CENTRIFUGE DRUM WITH A PISTON VALVE DEFINING ONE SIDE OF THE SLUDGE CHAMBER

BACKGROUND

The invention relates to a centrifugal separator drum having a piston valve defining one end of the solids chamber, the piston valve having a cap covering its central portion, on which cap an axial projection of the piston valve is sealingly guided with the use of a sealing ring, the said cap forming with the piston valve an opening chamber to which control fluid can be fed. On the opposite side of the piston valve, a closing chamber is provided.

Such a centrifugal separator drum is known from German Pat. No. 2,014,371. In this drum the opening chamber formed by the cap and the central portion of the piston valve is closed at its outer end, and at its inner end, it communicates with the closing chamber through a bore. After the closing chamber is filled, control fluid passes over through the said bore into the opening chamber and fills it up completely. Since the opening chamber is externally closed, the fluid cannot escape and it keeps the opening chamber constantly full with the piston valve in the closed position. The opening pressure exerted when the piston valve is in the closed position is therefore of virtually the same magnitude in a drum with a cap as it is in a drum without a cap. Besides, the closing pressure remains unchanged by the cap.

The ratio between the closing force and the opening force is determined by the construction of the drum in such a manner that, in the case of aqueous liquids which have to be separated, with the solids chamber completely filled with solids of a specific weight of up to about 1.3 g. $cm^{-3}$, the closing force is sufficiently predominant.

The closing pressure is reduced by letting control fluid out of the closing chamber. Under the effect of the now predominating opening force the piston valve moves to its open position. At the same time, the control fluid still present in the closing chamber is displaced inwardly by the reduction in volume, thereby again increasing the closing force on the one hand, while on the other hand, as the size of the opening of the annular gap that forms increases, the level of the liquid in the separating chamber recedes radially outwardly, thereby reducing the opening force. With the drum of the prior art it is brought about that the opening pressure on the central portion of the piston valve is sustained. This assures that in every case the valve will reach its end position in the open state.

In the centrifugal treatment of specifically heavier liquids with still heavier suspended solids it may happen that the ratio between the closing force and the opening force may not be great enough and the piston valve therefore no longer tightly seals the drum.

In the prior art drums there is a limit to this ratio of forces. If the piston surface being acted upon in the closing sense is located as far outward radially as possible and is made as great as possible in comparison with the piston surface being acted upon in the opening sense, no further increases of the ratio of forces is possible. With a drum of this kind only liquids whose components have no more than a certain specific weight can be handled.

The invention is addressed first to the problem of creating a centrifugal separating drum in which the piston surface acted upon in the opening sense is far smaller than it is in known centrifugal separating drums, so that even in the case of liquids of substantially higher specific weight the closing force will sufficiently predominate.

In order to be able to bring this drum rapidly to the end position of its open state especially when it is centrifugally separating specifically lighter liquids in which the closing force predominates to a greater extent, it is an additional object of the invention to make the opening force increasable from the outside.

The centrifugal separating drum is characterized in accordance with the invention in that the chamber is provided at its outer end with a passage extending through the piston valve and leading to the outside and is provided at its inner end with a separate feeding system for the control fluid.

In further development of the invention, the cap which shields the central portion of the piston valve from the pressure of the drum contents may be formed by the foot of the distributor. This makes it unnecessary to make a separate cap, and the drum becomes simpler.

Thus, the invention provides an improvement in the centrifugal separator of said German patent. U.S. Pat. No. 3,754,701 corresponds to said German patent. Thus, the invention deals with a centrifugal separator constructed for intermittent discharge of sludge. The separator includes a rotatably mounted separator drum having an upper end member and a lower end member enclosing the separating chamber, and at least one sludge discharge passageway disposed at the radially outward periphery of the drum. A piston valve is disposed within the drum defining one end of the separating chamber. The valve is movable vertically to open and close the sludge discharge passageway for desludging. A closing chamber is disposed outwardly of the piston valve extending from adjacent the axis of the drum to adjacent the radially outward periphery thereof, defined in part by the axially outward side of the piston valve. The closing chamber is for receiving and discharging fluid for, respectively, forcing the piston valve to the closed position and relieving force for initiating the moving the piston valve to its open position. Means are provided for supplying fluid to the closing chamber and means are provided for discharging fluid therefrom. A cap is mounted in the drum at a fixed axial position along the axis of the drum, covering a portion of the piston valve on the axially inwardly disposed side thereof. The piston valve is in sliding, sealing relation with the cap. The cap defines with the covered portion of the piston valve, an opening chamber for receiving and holding fluid for assisting the positioning of the piston valve to open said discharge passageway. Means are provided for supplying fluid to the opening chamber for said holding of fluid thereby. According to the invention, means are provided for discharging fluid from the opening chamber for the emptying thereof for assisting the positioning of the piston valve to close the discharge passageway in response to force imposed on the piston valve by fluid introduced into the closing chamber.

In a preferred embodiment, illustrated below, the cap covers a centrally disposed portion of the piston valve. The means for discharging fluid from the opening chamber includes a passageway in the piston valve communicating with the opening chamber with the piston valve in the closed position for receiving fluid from the opening chamber, and a passageway in the drum communicating with the piston valve passageway with the piston valve in the closed position for receiving fluid from the piston valve passageway and discharging the fluid from the drum.

The separator can comprise a distributor for introduction of material to be centrifuged into the drum along the center thereof, and the cap can be an extension of the distributor.

EMBODIMENT

An embodiment of the invention is represented in the drawing.

The drawing shows a centrifugal separator comprising a rotatably mounted drum having sludge discharge nozzle 14, a stack of separator plates 15 disposed centrally therein, and a sludge chamber 16 disposed outwardly of the separator plates 15.

The drum comprises an upper end member 18 and a lower end member 19 enclosing the separating chamber, and a piston valve 3 defining one end of the separating chamber. 1 designates the distributor neck and 2 the conical distributor foot. An axial projection 3*a* of the piston valve 3 is sealingly guided in its axial movements on the outer end of distributor foot 2, with the aid of a sealing ring 4. The distributor foot 2, which is an extension of the distributor, shields the central portion 3*b* of the piston valve 3 against the pressure of the drum contents. This considerably diminishes the piston area on which the drum contents act in the opening sense. Since the piston area that is acted upon from the closing chamber 5 in the closing sense is unchanged with respect to known drums, liquids of substantially higher specific weight can be handled by the drum of the invention.

Between the distributor foot 2, which does not move axially, and the central portion 3*b* of the axially displaceable piston valve 3, a chamber 6 is positively formed which permits the movement of the piston valve to its closed position and which can be free of pressure during the separating operation of the centrifuge in order to diminish the opening force. A spacer 17 is disposed between the separator plates 15 and the cap 2 formed by the extension of the distributor.

But especially in the centrifugal separation of specifically lighter liquids in which the closing force predominates to a greater extent, in order to be able to bring the piston valve rapidly to the end position of its open state, the chamber is provided on its inner end with a separate system 7, 8, 9 for control fluid, and communicates at its outer end with passages 10 and 10*a* extending, respectively, through the piston valve 3, and through the drum wall. A nozzle 11 may be installed at the inlet of passageway 10 to restrict flow out of opening chamber 6 when it is desired to fill chamber 6 with fluid. Overflow duct 8*a* is provided for capturing channel 8.

During the centrifugal separating periods the chamber 6 is free of fluid, so that only the smaller surface is exposed to the drum contents acting in the opening sense. When the control fluid is let out of chamber 5 by means of valve 12, the opening force is increased and the opening of the drum accelerated by the simultaneous admission of control fluid into chamber 6.

What is claimed is:

1. In a centrifugal separator constructed for intermittent discharge of sludge, comprising:

a. a rotatably mounted separator drum having an upper end member and a lower end member enclosing the separating chamber, at least one sludge discharge passageway disposed at the radially outward periphery of the drum, b. a piston valve disposed within the drum defining one end of the separating chamber, movable vertically to open and close the sludge discharge passageway for desludging, c. a closing chamber disposed outwardly of the piston valve extending from adjacent the axis of the drum to adjacent the radially outward periphery thereof, defined in part by the axially outward side of the piston valve, for receiving and discharging fluid for, respectively, forcing the piston valve to the closed position and relieving force initiating the moving of the piston valve to its open position, d. means for supplying fluid to the closing chamber and means for discharging fluid therefrom, e. a cap mounted in the drum at a fixed position along the axis of the drum, covering only a portion of the piston valve, on the axially inwardly disposed side thereof, the piston valve being in sliding, sealing relation with the cap, said cap defining with the covered portion of the piston valve, an opening chamber for receiving and holding fluid for assisting the positioning of the piston valve to open said sludge discharge passageway, f. means for supplying fluid to the opening chamber for said holding of fluid thereby, the improvement which comprises:

g. means for discharging fluid from the opening chamber for the emptying thereof for assisting the positioning of the piston valve to close said sludge discharge passageway in response to force imposed on the piston valve by fluid introduced into the closing chamber.

2. Separator according to claim 1, said cap covering a centrally disposed portion of the piston valve, said means for discharging fluid from the opening chamber comprising a passageway in the piston valve communicating with the opening chamber with the piston valve in the closed position, for receiving fluid from the opening chamber, and a passageway in the drum communicating with the piston valve passageway with the piston valve in the closed position, for receiving fluid from the piston valve passageway and discharging the fluid from the drum.

3. Separator according to claim 1, the separator comprising a distributor for introduction of material to be centrifuged into the drum along the center thereof, the cap being an extension of the distributor.

4. Separator according to claim 2, the separator comprising a distributor for introduction of material to be centrifuged into the drum along the center thereof, the cap being an extension of the distributor.

* * * * *